US007172665B2

(12) United States Patent
Mino

(10) Patent No.: US 7,172,665 B2
(45) Date of Patent: Feb. 6, 2007

(54) CU-BASED ALLOY AND METHOD OF MANUFACTURING HIGH STRENGTH AND HIGH THERMAL CONDUCTIVE FORGED ARTICLE USING THE SAME

(75) Inventor: Kazuaki Mino, Chiba (JP)

(73) Assignee: Ishikawajima-Harima Heavy Industries Co., Ltd. (JP)

( * ) Notice: Subject to any disclaimer, the term of this patent is extended or adjusted under 35 U.S.C. 154(b) by 287 days.

(21) Appl. No.: 10/359,343

(22) Filed: Feb. 4, 2003

(65) Prior Publication Data

US 2003/0155051 A1 Aug. 21, 2003

(30) Foreign Application Priority Data

Feb. 21, 2002 (JP) ..... P2002-044889

(51) Int. Cl.
*C22F 1/08* (2006.01)
*C22C 9/00* (2006.01)

(52) U.S. Cl. ..... 148/680; 148/681; 148/682

(58) Field of Classification Search ..... 148/680, 148/681, 682

See application file for complete search history.

(56) References Cited

U.S. PATENT DOCUMENTS 2,026,209 A 12/1935 Brace
2,033,709 A 3/1936 Hensel et al.
6,093,499 A 7/2000 Tomioka

FOREIGN PATENT DOCUMENTS

EP 1 143 021 A1 10/2001
JP 53-037992 4/1978
JP 4-198460 7/1992

(Continued)

OTHER PUBLICATIONS

Yoshikazu Sakai, et al., "Development of High-Strength, High-Conductive Copper-Silver Alloys", *Journal of the Japan Institute of Metals*, vol. 55, No. 12 (1991), pp. 1382-1391.

(Continued)

*Primary Examiner*—Sikyin Ip
(74) *Attorney, Agent, or Firm*—Ostrolenk, Faber, Gerb & Soffen, LLP

(57) ABSTRACT

A melt of a Cu-based alloy containing 2 to 6% (% by weight, the same shall apply hereinafter) of Ag and 0.5 to 0.9% of Cr are solidified by casting, and the solidified article after subjecting to a homogenizing heat treatment is subjected to hot-working. The hot-worked article is subjected to a solution treatment, the article is subjected to cold-working or warm-working by forging or rolling, and then the formed article is subjected to an aging treatment to obtain a metallic material capable of manufacturing a high strength and high thermal conductive metal formed article at a low price, regardless of the geometry, and a method of manufacturing the metal formed article using the same.

8 Claims, 1 Drawing Sheet

FOREIGN PATENT DOCUMENTS

| | | |
|---|---|---|
| JP | 04-221031 | * 11/1992 |
| JP | 04-221032 | * 11/1992 |
| JP | 6-279894 | 4/1994 |
| JP | 6-279894 | 10/1994 |
| JP | 2001-131655 | 5/2001 |
| JP | 2001-288517 | 10/2001 |
| SU | 644613 | 1/1979 |

OTHER PUBLICATIONS

Search Report from European Patent Office dated Apr. 15, 2003.
English Translation of Abstract for Japanese Patent No. 2001-131655.
English Translation of Abstract for Japanese Patent No. 4-198460.
English Translation of Abstract for Japanese Patent No. 6-279894.

* cited by examiner

CU-BASED ALLOY AND METHOD OF MANUFACTURING HIGH STRENGTH AND HIGH THERMAL CONDUCTIVE FORGED ARTICLE USING THE SAME

BACKGROUND OF THE INVENTION

1. Field of the Invention

The present invention relates to a Cu-based alloy and to a method of manufacturing a high strength and high thermal conductive forged article using the same.

2. Description of Related Art

Metallic materials having high strength and high thermal conductivity are used in members exposed to severe thermal fatigue, for example, thrust chambers of rocket engines, structures in fusion reactors (wherein one surface may contact a combustion gas of 3000° C. and the other surface may contact liquid hydrogen), and molds.

Examples of a high strength and high thermal conductive alloy used in the field include Cu-based alloy containing 0.8% (hereinafter all percentages are by weight in the present specification) of Cr and 0.2% of Zr as described in Japanese Unexamined Patent Application, First Publication No. Hei 4-198460. Generally, the Cu-based alloy is formed into a predetermined shape by forging and rolling after casting, and then the formed article is subjected to a predetermined heat treatment to obtain a high strength and high thermal conductive forged article. The tensile strength of the Cu-based alloy can be enhanced by controlling the conditions of a thermomechanical treatment while maintaining the thermal conductivity at a high level, regardless of it having the same composition.

However, since the service conditions of members of the apparatus became severe in view of the production of thermal stress and it was pointed out that a conventional material has a short lifetime up to the occurrence of cracking, higher thermal fatigue resistance has recently been required. To suppress the production of thermal strain of a metallic material, an improvement in thermal conductivity and an increase in thermal fatigue strength are required. Since the improvement in thermal conductivity has nearly reached the limit, it is desired to increase the thermal fatigue strength without reducing the thermal conductivity as compared with a conventional metallic material.

It has already been found that the tensile strength and the tensile proof stress are enhanced without reducing the thermal conductivity at a service temperature so as to enhance the thermal fatigue strength. To achieve the above object, there have been trials to increase the strength by further increasing a proportion of Cr or Zr in the above Cu-based alloy containing Cr (0.8%) and Zr (0.2%) as a base, thereby increasing a reduction ratio. When the proportion of Cr or Zr is increased and a fibrous fine structure is formed by swaging or wire drawing capable of introducing large strain in one direction, high strength can be obtained. However, contrary to expectations, the thermal fatigue strength is not increased because of poor ductility and sufficient forging and rolling cannot be conducted because of limits to the shape of the formed article, and thus it is difficult to obtain a desired strength in a formed article having any shape. Therefore, its application was limited to electrical members utilizing high strength and high electrical conductivity.

As described in Japanese Unexamined Patent Application, First Publication No. Hei 6-279894 and "Sakai et al., Journal of The Japan Institute of Metals, Vol. 55 (1991), pages 1382 to 1391", a Cu-based alloy containing a large amount of Ag added therein has been developed as a novel alloy system.

Similar to Cr or Zr, Ag has small solid solubility in Cu near room temperature and therefore exhibits a small decrease in thermal conductivity as a result of alloying. In the Cu-based alloy containing 8.5% or more of Ag added therein, a eutectic crystal is formed upon solidification. When an ingot of the Cu-based alloy, to which 15% of Ag was added to obtain a sufficient amount of a eutectic structure, is subjected to swaging or wire drawing during which large strain is introduced in one direction, like the above Cu—Cr—Zr alloy, the eutectic structure is broken to form a fiber-reinforced structure. Although the strength thus obtained is very high, it becomes necessary to conduct high reduction that enables a cast round bar to be formed into a wire rod having a diameter which is one-tenth that of the cast round bar, and thus a formed article having a certain measure or more of the wall thickness could not be obtained by this technique.

BRIEF SUMMARY OF THE INVENTION

The present invention was made in view of the above problems and an object thereof is to provide a metallic material capable of manufacturing a high strength and high thermal conductive metal formed article at a low price by a simple method regardless of geometry, and a method of manufacturing the metal formed article using the same.

To achieve the object, the present invention provides a high strength and high thermal conductive Cu-based alloy comprising at least 2 to 6% (% by weight; the same below) of Ag and 0.5 to 0.9% of Cr.

The above Cu-based alloy may further contain 0.05 to 0.2% of Zr.

Also, the present invention provides a method of manufacturing a high strength and high thermal conductive forged article, which comprises the first step of melting the above forging Cu-based alloy; the second step of solidifying the molten alloy obtained in the first step by casting; the third step of subjecting the solidified article obtained in the second step to a homogenizing heat treatment at a temperature within a range from 780 to 950° C.; the fourth step of subjecting the heat-treated article obtained in the third step to hot working by forging or rolling at a temperature within a range from 750 to 950° C.; the fifth step of subjecting the hot-worked article obtained in the fourth step to a solution treatment at a temperature within a range from 750 to 980° C.; the sixth step of subjecting the heat-treated article obtained in the fifth step to at least 5% cold working or warm working at a temperature equal to or less than 500° C. by forging or rolling; and the seventh step of subjecting the formed article obtained in the sixth step to an aging treatment at a temperature within a range from 370 to 500° C. for 0.1 hours or more.

As used herein, the term "homogenizing heat treatment" means a treatment wherein segregation of the alloying elements is eliminated by heating a solidified article obtained by casting to high temperature in a state so as to cause no macroscopic melting.

Also the term "solution treatment" means a treatment wherein a coarse precipitate grown during the hot working is decomposed by heating a hot-worked article to high temperature.

Also the term "aging treatment" means a treatment wherein a heterogeneous phase is precipitated in a structure by maintaining a solid solution at a predetermined temperature for a predetermined time.

In the above method, the material obtained in the third step is preferably hot-worked by hot forging or rolling at a ratio of cross section or length between before and after subjecting the material to hot working (hereinafter referred to as a "forging ratio") of 1.5 or more.

In the above method, the solution treatment in the fifth step is preferably conducted for 0.1 to 10 hours.

In the above method, the treatment conditions, the treatment temperature and the treatment time, of the aging treatment in the seventh step are preferably decided so that a value of a parameter represented by (treatment temperature expressed by absolute temperature)×(20+common logarithm of treatment time expressed by hours) is within a range from 13000 to 15000.

Since the forging Cu-based alloy of the present invention contains Ag and Cr, or Ag, Cr and Zr in an amount within a proper range, it is made possible to easily manufacture a high strength and high thermal conductive forged Cu-based alloy article by forging using the method of manufacturing a forged article of the present invention. dr

DETAILED DESCRIPTION OF THE INVENTION

Figure 1:
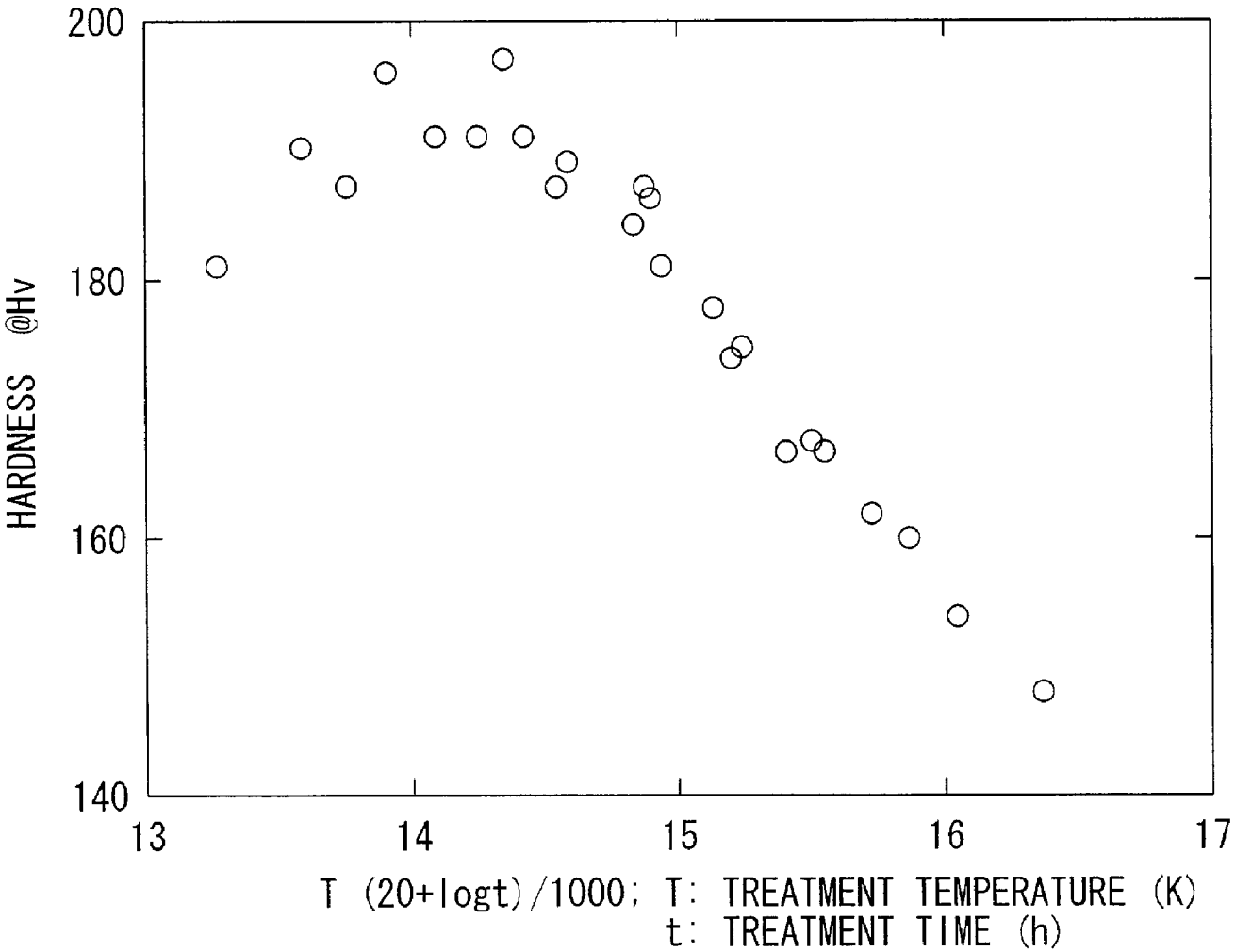
FIG. 1 is a graph showing the relationship between the conditions and hardness, of an aging treatment of a forged Cu-based alloy article.

The present invention is now described below.

The forging Cu-based alloy of the present invention comprises 2 to 6% by weight of Ag and 0.5 to 0.9% by weight of Cr with the balance being Cu.

It has been found that a formed article having high thermal conductivity and high strength containing inexpensive Cu as a base can be obtained by further adding Ag to the forging Cu-based alloy containing a small amount of Cr or Cr and Zr added therein of the present invention using a simple method such as casting or forging and rolling. Therefore, when using this forging Cu-based alloy, a high strength and high thermal conductive forged article can be manufactured regardless of the form, for example, a large-sized product.

When the content of Ag is less than 2% in the Cu-based alloy with the above composition, the hardness of the resulting forged article is reduced and a high strength and high thermal conductive forged article cannot be obtained. On the other hand, when the content of Ag exceeds 6%, hot working cracking is likely to occur.

When the content of Cr is less than 0.5%, the hardness of the resulting forged article is reduced and a high strength and high thermal conductive forged article cannot be obtained. On the other hand, even when Cr is added in an amount of more than 0.9%, less effect is exerted and it becomes disadvantageous in view of the cost.

Further addition of 0.05 to 0.2% of Zr makes it possible to suppress embrittlement. When the content of Zr is less than 0.05%, embrittlement is not sufficiently suppressed. However, it is not always necessary to add Zr in the case of employing the method of manufacturing a high strength and high thermal conductive forged article of the present invention. Even when Zr is added in the amount of more than 0.2%, less effect is exerted and it becomes disadvantageous in view of the cost, similar to Cr.

The method of manufacturing a high strength and high thermal conductive forged article of the present invention comprises the first step of melting the above forging Cu-based alloy; the second step of solidifying the molten alloy obtained in the first step by casting; the third step of subjecting the solidified article obtained in the second step to a homogenizing heat treatment at a temperature within a range from 780 to 950° C.; the fourth step of subjecting the heat-treated article obtained in the third step to hot working by forging or rolling at a temperature within a range from 750 to 950° C.; the fifth step of subjecting the hot-worked article obtained in the fourth step to a solution treatment at a temperature within a range from 750 to 980° C.; the sixth step of subjecting the heat-treated article obtained in the fifth step to at least 5% cold working or warm working at a temperature equal to or lower than 500° C. by forging or rolling; and the seventh step of subjecting the formed article obtained in the sixth step to an aging treatment at a temperature within a range from 370 to 500° C. for 0.1 to 20 hours.

According to the method of manufacturing a high strength and high thermal conductive forged article of the present invention, segregation of the alloying elements is eliminated by subjecting the solidified article obtained by passing through the first and second steps to a homogenizing heat treatment at a temperature within a range from 780 to 950° C. in the third step. That is, in the process of melting the alloy composed of various elements and solidifying the melt by casting, a phase having a high melting point is solidified first and a phase having the lowest melting point (phase which generally contains a large amount of the alloying elements) is finally solidified, thereby to cause segregation of the alloying elements added and large macroscopic change of the alloying elements. Then, the solidified article is subjected to a homogenizing heat treatment, namely, heating to high temperature in a state so as to cause no macroscopic melting, and thus diffusion of the elements occurs and segregation is eliminated.

When the treatment temperature is lower than 780° C., the eutectic reaction occurs during the heating upon forging because of insufficient diffusion. On the other hand, when the treatment temperature exceeds 950° C., the base material is melted during the diffusion treatment. Therefore, it is not preferred.

According to the method of the present invention, the heat-treated article obtained in the third step is hot-worked by forging or rolling at a temperature within a range from 750 to 950° C. in the fourth step. When the treatment temperature is lower than 750° C., cracking is likely to occur during the following cold working or warm working. On the other hand, when it exceeds 950° C., the base material is melted. Therefore, it is not preferred.

By conducting the hot working in the fourth step at a forging ratio of 1.2 or more, a fine structure (recrystallized structure) composed of uniform crystal grains can be obtained. In the case in which the forging ratio is less than 1.2, a partially completed recrystallized structure is obtained. In the case of manufacturing a large-sized forged article, the forging ratio is preferably controlled to 1.5 or more to uniformly introduce work strain. In the case in which the plate thickness is 200 mm or more, the forging ratio is preferably controlled within a range from 5 to 15.

According to the method of the present invention, the hot-worked article obtained in the fourth step is subjected to a solution treatment at a temperature within a range from 750 to 980° C. in the fifth step, thereby to decompose a grown coarse precipitate. In the sixth step, the heat-treated article obtained in the fifth step is subjected to at least 5% cold working or warm working at a temperature equal to or lower than 500° C. by forging or rolling. In the seventh step, the formed article obtained in the sixth step is subjected to an aging treatment at a temperature within a range from 370 to 500° C. for 0.1 to 20 hours, thereby to precipitate a heterogeneous phase in the structure.

In the process of maintaining the high temperature state such as hot working for a long time, since a coarse precipitate is likely to be grown, the hot-worked article is once decomposed by the solution treatment and then subjected to the aging treatment, thereby to precipitate a fine heterogeneous phase. Also when the hot-worked article is worked (introduction of work strain) before the aging treatment, a precipitation phenomenon is caused by defects, which serves as a nucleation site, such as a dislocation formed during the working, and thus more fine precipitate is formed. Therefore, the strength of the forged article is improved by refining of the structure.

When the treatment temperature of the solution treatment in the fifth step is lower than 900° C., solid-solutioning of a chromium precipitate becomes insufficient. On the other hand, when it exceeds 980° C., serious defects (pores) such as cavities are formed in the structure. Therefore, it is not preferred. As the temperature of the heat treatment becomes higher, the growth of crystal grains is more activated and formation of coarse grains as a factor for impairing the fatigue strength is more promoted. Since solid-solutioning of the precipitate occurs at 720° C. or higher, precipitation strengthening due to silver is achieved by heating to 750° C. or higher.

When imparting of the working in the sixth step is less than 5%, less effect is exerted on an improvement in strength.

When the treatment temperature of the aging treatment in the seventh step is lower than 370° C., the required treatment time is prolonged. On the other hand, when it exceeds 500° C., the degree of work hardening is small, and moreover, solid-solutioning of a portion of the precipitate of Ag or Cr occurs, thereby to cause coarsening of the precipitate. Therefore, it is not preferred. The coarse precipitate thus obtained is not refined when the temperature is lowered, and thus precipitation strengthening is drastically reduced.

To decide the treatment conditions of the aging treatment in the seventh step, the treatment temperature and the treatment time are preferably decided so that a value of a parameter represented by (treatment temperature expressed by absolute temperature)×(20+common logarithm of treatment time expressed by hours) is within a range from 13000 to 15000. Consequently, a forged article having high hardness can be reliably obtained.

EXAMPLE 1-1

Preparation (1) of Cu-based alloy

Raw materials each having the total weight of 2 kg prepared by adding 2%, 4%, 6%, and 8% of Ag to a master alloy comprising 0.7% of Cr and 0.13% of Zr with the balance being Cu were melted in an argon atmosphere and the resulting molten alloys were poured into a chilled mold and then solidified. Square bars of 30 mm in width, 35 mm in height and 120 mm in length were cut from the resulting solidified articles and then hot-rolled into rolled articles having a thickness of 18 mm at 900° C.

As a result, cracking (cracking occurring at the side edges, hot working cracking) was not observed in the rolled articles containing 2% and 4% of Ag, while less cracking was recognized in the rolled article containing 6% of Ag. In the rolled article containing 8% of Ag, cracking propagating to the depth of several mm from the end portion was observed.

Therefore, the amount of Ag added is preferably limited to 6% or less to obtain a forged article with less hot working cracking.

Cr and Zr are effective elements as precipitation strengthening elements, but exhibit small solid solution content in the solid state after solidification of the molten alloy, for example, at most 0.73% and 0.15% even in the high temperature state. Since the segregation of these elements during the solidification cannot be avoided and hardly disappears, a portion of the total amount of these elements added is wasted as a "coarse precipitate" which is not effective for precipitation strengthening. It is appropriate that the amount of the elements wasted is estimated as about 20% of the total amount. Therefore, the maximum amount of Cr is preferably limited as follows: $0.73\times1.2=0.9(\%)$. Similarly, the maximum amount of Zr is preferably limited as follows: $0.5\times1.2\approx0.2(\%)$.

EXAMPLE 1-2

Preparation (2) of Cu-based alloy

A raw material having the total weight of 2 kg prepared by adding 0.2% of Zr to a master alloy comprising 4% of Ag and 0.7% of Cr with the balance being Cu and a raw material having the total weight of 2 kg prepared by adding no Zr to the same master alloy were melted in an argon atmosphere and the resulting molten alloys were poured into a chilled mold and then solidified. Square bars of 30 mm in width, 35 mm in height and 120 mm in length were cut from the resulting solidified articles and then hot-rolled into rolled articles having a thickness of 18 mm at 500° C. and 750° C.

As a result, cracking (cracking occurring at the side edges, hot working cracking) was not observed in all rolled articles containing 0.2% of Zr added therein. Deep cracking of several mm was observed in the rolled articles treated at 500° C. among rolled articles obtained from the material prepared by adding no Zr, while thin cracking was observed in the rolled articles treated at 750° C.

Using concave upper and lower dies (molds), the material prepared by adding no Zr was placed into a forging press in the state of being forged. As a result, no cracking occurred in the rolled articles treated at 750° C.

As is apparent from these results, it is not always unnecessary to add Zr, which is deemed to be effective for hot workability, by improving the working method. The method is preferably a working method which causes as little tensile stress as possible.

It is effective to add Zr which is a precipitation strengthening element. However, in the case of a particularly large ingot, for example, one of dozens of kilograms to several tons of a forged article, severe segregation is caused by adding a large amount of Zr. Therefore, the amount of Zr added is preferably limited to at most 0.2%.

EXAMPLE 2

Homogenizing Heat Treatment

A master alloy comprising 4% of Ag, 0.7% of Cr and 0.13% of Zr with the balance being Cu was melted and the resulting molten alloy was poured into a chilled mold and then solidified to obtain 350 kg of a large cast ingot.

0.2 g of a block was sampled from the center portion of the cast ingot and thermal analysis of the block was conducted. As a result, the eutectic reaction between Cu and Ag occurs at 780° C. in case of this alloy.

Before the thermal analysis, this alloy was heated for the purpose of homogenization of the structure, namely, elimination of the segregation of alloying elements. In the case in which this alloy was heated to 700° C. for 20 hours, the eutectic reaction occurred. In the case in which the alloy was heated to 780 to 800° C. for 2.5 hours, Ag diffused vigorously and a eutectic reaction peak disappeared. It has been found that when the heating temperature exceeds 950° C., partial melting of a base metal is initiated even if the eutectic reaction disappeared.

Therefore, it has been found that the temperature within a range from 780 to 950° C. is suitable for the homogenizing heat treatment of this alloy.

Tensile test specimens were sampled from the heat-treated articles obtained by subjecting the cast ingot to a heat treatment (homogenizing heat treatment) at 900° C. for 2.5 hours and 20 hours and the cast ingot which was not subjected to the homogenizing heat treatment and, after heating to 800° C., a tension test was conducted and the elongation after fracture was measured. As a result, the elongation after fracture of the specimen subjected to the homogenizing heat treatment at 900° C. for 2.5 hours was 6%, the elongation after fracture of the specimen subjected to the homogenizing heat treatment at 900° C. for 20 hours was 5%, and the elongation after fracture of the specimen which was not subjected to the homogenizing heat treatment was 0%. As a result, it has been found that homogenizing heat treatment is effective to suppress hot working cracking.

Also, it has been found that that the homogenizing heat treatment is effective to suppress hot working cracking in actual hot working (hot rolling).

Furthermore, some sample alloys, each having a composition ratio different from that of the above sample alloys, comprising 2 to 6% of Ag, 0.5 to 0.9% of Cr and 0 to 0.2% of Zr were tested in the same manner. As a result, the same results were obtained with respect to the effect of the homogenizing heat treatment.

It has been found that, in the case in which the content of Ag is 6%, the effect of the homogenizing heat treatment is lowered and cracking (hot working cracking) occurs. Also, it has been found that less cracking occurred when using a small cast ingot having a weight of about 2 kg. When using a large cast ingot having a weight of several hundred kg, the amount of Ag added is preferably controlled to be less than 6% in view of the yield of the material.

EXAMPLE 3

Hot Working

The cast ingot used in Example 2 was subjected to a homogenizing heat treatment at 900° C. and then subjected to 20% rolling at 700° C. As a result, no cracking (hot working cracking) occurred. When the rolled article was subjected to a solution treatment at 950° C. and was then subjected to 20% cold rolling, severe cracking occurred.

The factor of the severe cracking was examined and it was found that segregation, which could not be completely eliminated by the homogenizing heat treatment, caused partial melting as a result of heating to 950° C., to form small cavities (pores) which extended during the cold rolling.

The cast ingot used in Example 2 was subjected to a homogenizing heat treatment at 900° C., 20% rolling at 750 to 950° C., a solution treatment at 950° C. and then 20% cold rolling. As a result, no cracking occurred.

In this case, when rolling was conducted at 900° C., recrystallization is caused by at least 20% rolling, while a partially imperfect recrystallized structure is obtained by about 10% rolling.

As is apparent from the above results, in the case of introducing uniform work strain such as rolling, about 20% working is conducted, that is, a forging ratio is preferably controlled to about 1.2 or more. Since it is difficult to uniformly introduce work strain in a large forged article, the forging ratio is preferably controlled to 1.5 or more.

In the case in which the plate thickness is 200 mm or more, the forging ratio is preferably controlled to be within a range from 5 to 15. It has been found that a fine structure composed of uniform crystal grains having a grain size of about 100 μm can be obtained by subjecting the forged article obtained by forging to a solution treatment.

EXAMPLE 4

Solution Treatment, Cold Working and Warm Working

After the cast ingot used in Example 2 was subjected to a homogenizing heat treatment at 900° C., a block of 100 mm in thickness and 150 mm in width was pressed into a hot-worked article having a thickness of 25 mm by hot forging. Then, the hot-worked article was subjected to a solution treatment at a temperature within a range from 750 to 980° C. and water-cooled. After subjecting to 20% rolling (cold working/warm working) at 400° C., an aging treatment was conducted at 420° C. for 1.5 hours and hardness (Vickers hardness) was measured at room temperature. The results are shown below.

| Forging temperature (° C.) | Vickers hardness (Hv) |
|---|---|
| 750 | 150 |
| 850 | 160 |
| 905 | 175 |
| 920 | 187 |
| 950 | 187 |
| 980 | 183 |

As is apparent from the above results, high age hardenability can be obtained by conducting the solution treatment at a temperature within a range from 750 to 980° C.

Although the age hardening occurs remarkably at a temperature within a range from 920 to 980° C. coarse grains were recognized in crystal grains. Since coarse grains reduce the fatigue strength as described above, the treatment is preferably conducted in a relatively high temperature range for a short time, while the treatment is preferably conducted in a relatively low temperature range for a long time, for example, about 0.1 to 1 hours.

the solution treatment was conducted at 1000° C. As a result, substantial numbers of cavities (pores) were formed in the hot-worked article.

A reduction ratio by cold or warm working before the aging treatment is preferably selected according to the purposes of the forged article. Even if a rolling reduction ratio was reduced 15% at 400° C., the hardness scarcely changed after the aging treatment. It has been found that, even if the rolling reduction ratio was reduced to 5 to 10%, the hardness slightly changed after the aging treatment, but a sufficient effect of improving the strength can be obtained.

EXAMPLE 5

Aging Treatment

The case ingot used in Example 2 was subjected to a homogenizing heat treatment 900° C. subjected to 45% hot rolling at 900° C., and then the hot-worked article was subjected to a solution treatment 950° C. and subjected to 20% rolling (cold working/warm working) at 400° C. An aging treatment was conducted under various conditions of a treatment temperature within a range from 400 to 500° C. and treatment time within a range from 0.5 to 30 hours, and then the hardness (Vickers hardness) of the treated article was measured. The results are shown in FIG. 1.

In FIG. 1, the treatment conditions were arranged using a parameter represented by the formula: $T\times(20+\log t)$, where T denotes a treatment temperature (K) indicated by an absolute temperature and t denotes a treatment time (h).

When the aging treatment is conducted under the treatment conditions so that the parameter is within a range from 13400 to 14700, the hardness of Hv 185 or higher is obtained. For example, when the treatment temperature becomes higher, the treatment time may be about 0.1 hours. When the treatment temperature is controlled to 370° C., a treatment time of about one day is required.

To obtain the hardness of Hv 180 or higher, there may be selected treatment conditions so that the parameter is within a range from 13000 to 15000.

To conduct solutioning of the precipitate obtained during the solidification or in the prior step by a solution treatment, the heating time may be approximately 5 minutes. In the case of a thin plate having a weight of several kg or a thickness of about 10 mm, it requires about 10 minutes to uniformly heat from the surface to the inside because this copper alloy has excellent thermal conductivity. Therefore, the solution treatment may be conducted for 15 minutes after the surface temperature of the article to be treated has reached a predetermined temperature. In such a treatment, the optimum treatment temperature is about 470° C. as a result of calculation of the paramater. On the other hand, a large article requires a longer time until the temperature of the entire large article becomes uniform. Although the temperature is gradually raised from about 300° C., there is a difference between the temperature of an oven and the temperature of the article to be treated, and thus the treatment time is inaccurate and it inevitably must be substantially controlled for about one hour. In this case, the optimum treatment temperature is about 430° C.

As described above, it is preferred to control the age hardening using the parameter so as to obtain the optimum hardness.

What is claimed is:

1. A method of manufacturing a high strength and high thermal conductive forged article, comprising a first step of melting a high strength and high thermal conductive Cu-based alloy comprising at least 2 to 6% by weight of Ag and 0.5 to 0.9% by weight of Cr; a second step of solidifying the molten alloy obtained in the first step by casting; a third step of subjecting the solidified article obtained in the second step to a homogenizing heat treatment which substantively eliminates segregation of alloying elements in the solidified article by heating during a predetermined time at a temperature within a range from 780 to 950° C.; a fourth step of subjecting the heat-treated article obtained in the third step in which diffusion of the alloying elements occurs and segregation of the alloying elements has been eliminated by the third step, to hot working by forging or rolling at a temperature within a range from 750 to 950° C.; a fifth step of subjecting the hot-worked article obtained in the fourth step to a solution treatment at a temperature within a range from 750 to 980° C.; a sixth step of subjecting the heat-treated article obtained in the fifth step to at least 5% cold working or warm working at a temperature equal to or lower than 500° C. by forging or rolling; and a seventh step of subjecting the formed article obtained in the sixth step to an aging treatment at a temperature within a range from 370 to 500° C. for 0.1 hours or more.

2. A method of manufacturing a high strength and high thermal conductive forged article according to claim 1, wherein the hot working in the fourth step is conducted at a forging ratio of 1.5 or more.

3. A method of manufacturing a high strength and high thermal conductive forged article according to claim 1, wherein the solution treatment in the fifth step is conducted for 0.1 to 10 hours.

4. A method of manufacturing a high strength and high thermal conductive forged article according to claim 1, wherein the treatment conditions, the treatment temperature and the treatment time, of the aging treatment in the seventh step are decided so that a value of a parameter represented by (treatment temperature expressed by absolute temperature)×(20+common logarithm of treatment time) is within a range from 13000 to 15000.

5. A method of manufacturing a high strength and high thermal conductive forged article, comprising a first step of melting a high strength and high thermal conductive Cu-based alloy comprising at least 2 to 6% by weight of Ag, 0.5 to 0.9% by weight of Cr, and 0.05 to 0.2% by weight of Zr; a second step of solidifying the molten alloy obtained in the first step by casting; a third step of subjecting the solidified article obtained in the second step to a homogenizing heat treatment in order to eliminate segregation of alloying elements in the solidified article by heating during a predetermined time at a temperature within a range from 780 to 950° C.; a fourth step of subjecting the heat-treated article obtained in the third step in which diffusion of the alloying elements occurs and segregation of the alloying elements has been eliminated by the third step, to hot working by forging or rolling at a temperature within a range from 750 to 950° C.; a fifth step of subjecting the hot-worked article obtained in the fourth step to a solution treatment at a temperature within a range from 750 to 980° C.; a sixth step of subjecting the heat-treated article obtained in the fifth step to at least 5% cold working or warm working at a temperature equal to or lower than 500° C. by forging or rolling; and a seventh step of subjecting the formed article obtained in the sixth step to an aging treatment at a temperature within a range from 370 to 500° C. for 0.1 hours or more.

6. A method of manufacturing a high strength and high thermal conductive forged article according to claim 5, wherein the hot working in the fourth step is conducted at a forging ratio of 1.5 or more.

7. A method of manufacturing a high strength and high thermal conductive forged article according to claim 5, wherein the solution treatment in the fifth step is conducted for 0.1 to 10 hours.

8. A method of manufacturing a high strength and high thermal conductive forged article according to claim 5, wherein the treatment conditions, the treatment temperature and the treatment time, of the aging treatment in the seventh step are decided so that a value of a parameter represented by (treatment temperature expressed by absolute temperature)×(20+common logarithm of treatment time) is within a range from 13000 to 15000.

* * * * *